United States Patent [19]

Garceau

[11] 3,958,610

[45] May 25, 1976

[54] INNERSPRING

[75] Inventor: Harry A. Garceau, Charlton, Mass.

[73] Assignee: Webster Spring Co. Inc., Oxford, Mass.

[22] Filed: Feb. 24, 1975

[21] Appl. No.: 552,641

[52] U.S. Cl. ..... 140/3 CA; 140/105
[51] Int. Cl.[2] ..... B21F 27/16
[58] Field of Search ..... 140/3 R, 3 CA, 105, 140/112

[56] References Cited

UNITED STATES PATENTS

| | | | |
|---|---|---|---|
| 1,513,032 | 10/1924 | Bull | 140/105 |
| 2,164,481 | 7/1939 | Watkins | 140/112 |
| 3,298,402 | 1/1967 | Hale | 140/112 |
| 3,577,574 | 5/1971 | Ciampa | 140/3 |

*Primary Examiner*—Lowell A. Larson
*Attorney, Agent, or Firm*—Robert T. Gammons

[57] ABSTRACT

The method of making a grid of a predetermined length embodying crossing longitudinally and transversely extending spaced parallel wires welded at their crossings wherein the portions of the longitudinally extending wires between the transversely extending wires contain depressions for receiving attaching elements at the ends of coiled springs, comprising forming the grid with the transverse wires spaced in the longitudinal direction of the grid so that any whole number of spaces in the longitudinal direction exceed the length of the assembly and then forming the depression in the portion of the longitudinally extending wires between the transversely extending wires by an amount such that collectively they reduce the distance between the transversely extending wires so that a whole number of the spaces between the transversely extending wires correspond to the length of the assembly desired.

7 Claims, 10 Drawing Figures

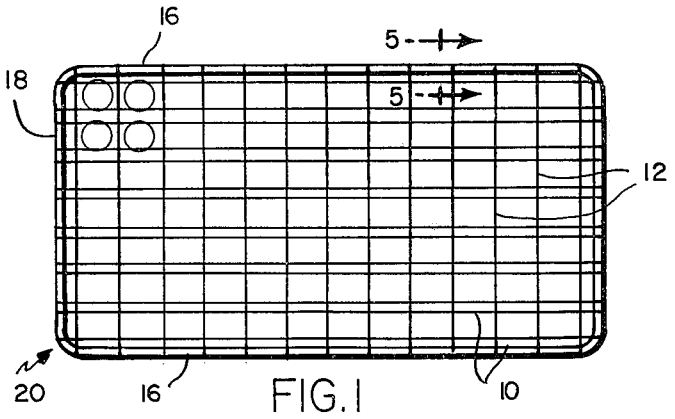
FIG. 1
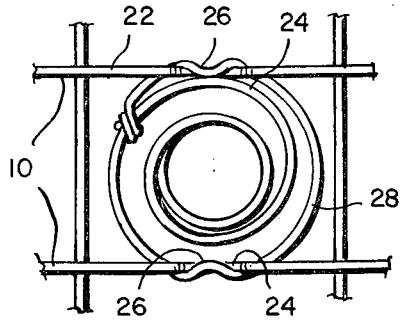
FIG. 3
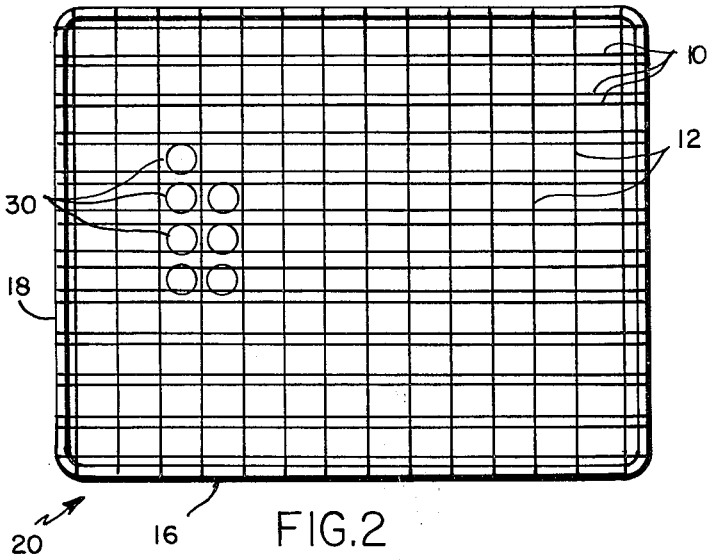
FIG. 2
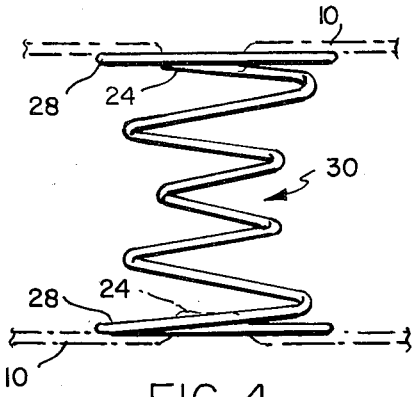
FIG. 4
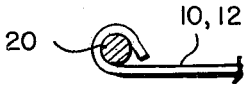
FIG. 5
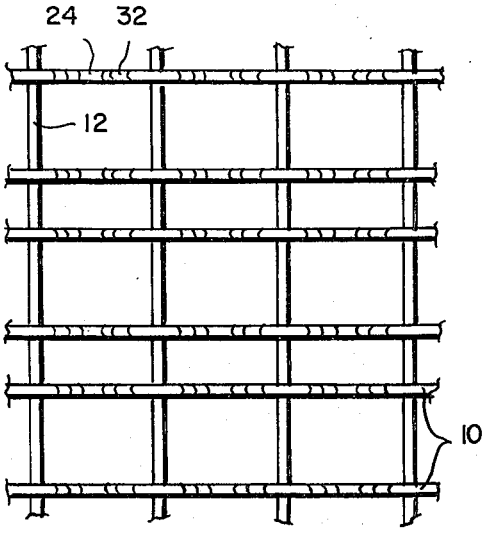
FIG. 6
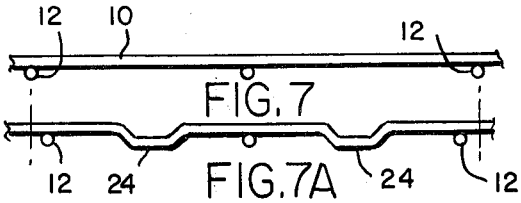
FIG. 7
FIG. 7A
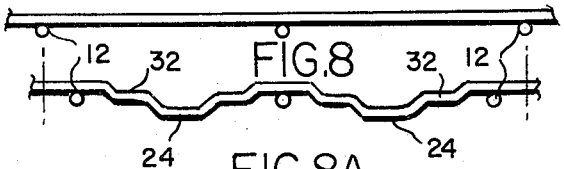
FIG. 8
FIG. 8A

INNERSPRING

BACKGROUND OF INVENTION

In my U.S. Pat. No. 3,662,411 there is shown a spring assembly comprised of a grid having longitudinally extending and transversely extending wires welded at their crossings to each other to which the end loops of coiled springs are adapted to be attached by engagement of ears formed in the end loops of the coils with depressions formed in the wires of the grid. The depressions in the wires of the grid are formed in portions of adjacent wires extending in one direction between the adjacent wires extending in the other direction. It is the purpose of this invention to make it possible to assemble the crossing wires at a predetermined spacing for welding to form a mat which may then be reduced to an overall length by forming the depressions, to one of several desired grid lengths, thereby avoiding the necessity of changing the spacing of the wires for welding for making grids of different lengths.

SUMMARY OF INVENTION

A method of making grids to which coil springs are adapted to be attached for the manufacture of spring assemblies, wherein a plurality of wires are arranged in spaced parallel crossing relation to each other with the wires running in one direction crossing the wires running in the other direction and with the wires welded at their crossings and wherein there are depressions in the portions of the wires running in one direction between the portions of the wires running in the other direction, comprising forming said depressions downwardly from the plane of the grid by an amount such that the collective depressions reduce the overall length of the wires running in the other direction to a predetermined length corresponding to the desired length of the grid to be made.

The invention will now be described in greater detail with reference to the accompanying drawings, wherein:

FIG. 1 is a plan view of a grid suitable for full or twin size spring assemblies;

FIG. 2 is a view corresponding to FIG. 1, illustrating a grid of a length suitable for king or queen size assemblies;

FIG. 3 is a plan view of pairs of crossing wires with a coiled spring attached thereto;

FIG. 4 is an elevation showing a single coiled spring attached at its upper and lower ends to upper and lower grids;

FIG. 5 shows a portion at one end of a wire connected to the border wire;

FIG. 6 is an enlarged plan view of a portion of a single grid;

FIGS. 7 and 7A are sections of a mat of crossing wires before and after forming single depressions in the longitudinal wires, and FIGS. 8 and 8A are sections similar to FIGS. 7 and 7A where the longitudinal wires contain two depressions.

As illustrated herein, the grids are made up of longitudinally and transversely extending spaced parallel wires 10—10 and 12—12 which cross at right angles to each other and are welded at their intersections. The ends of the wires are connected by being bent over the longitudinal and transverse runs 16 and 18 of the border wire 20 which, as shown, is of rectangular configuration and is comprised of a wire of much heavier cross section than that of the longitudinally and transversely extending wires 10 and 12.

In my U.S. Pat. No. 3,662,411 there is shown a grid of this kind in which the portions 22 of the wires in one direction between the pairs of wires in the other direction are depressed from the plane of the grid to provide depressions 24, as shown in FIGS. 3 and 7, for receiving ears 26 at diametrically opposed places on the end loops 28 of double end spring coils 30, such as shown in FIG. 4. The ears 26 are sprung into the depressions either by compressing the sides of the end coils to extend the distance between the ears so that they may be engaged over the wires or by drawing the wires toward each other sufficiently to permit the ears to be engaged therewith. In either case the return of the wires to their original positions will interlock the ends of the coils with the grids.

In making a complete spring assembly a plurality of coil springs 30 are mounted between two grids and their ends engaged with the respective grids in the desired number to provide for the resiliency and strength specified.

Spring assemblies are made up in different lengths and widths, the customary lengths being 73 inches for full and twin size spring assemblies and 78 for king and queen size spring assemblies. From the standpoint of economy in manufacture it is desirable to attach the longitudinally and transversely extending wires at a predetermined uniform spacing for welding of the crossing wires to each other prior to formation of the depressed portions which are for the purpose of attaching the springs thereto and prior to attaching the wires to the border wire. According to this invention to avoid having to arrange the crossing wires at different spacings in order to accommodate the grids to the different lengths desired a mat comprised of crossing wires 10 and 12 with the wires welded at their intersections is made up, as shown in FIG. 7, with the wires at a predetermined spacing whereupon the depressed portions 24 are formed of such depth that they collectively reduce the overall length of the longitudinally extending wires 10 to the predetermined lengths of the border wire of the grid which is to be made up. Thus, for the 73 inch border wire of 78 inches the depressions 24 would be made of a lesser depth.

If the depressions 24, as illustrated in FIG. 7, do not take up a sufficient amount of the length of the longitudinally extending wires to reduce the overall length the desired amount additional depressions 32 may be formed at opposite ends of the depressions 24, as shown in FIGS. 8 and 8A.

As herein illustrated the transversely extending wires are perfectly straight, however, it is to be recognized that the depressions could be made in the transverse wires for the same purpose to accommodate for assemblies of different width.

In making the grids an entire fabric comprised of the crossing wires may be made up of somewhat greater longitudinal length than the lengths of the border wire to which it is to be attached, whereupon the entire number of depressions 24 and/or the depressions 24, 32 may be made at one time. Alternatively, the fabric or mat may be made by successively attaching the wires 12 to the longitudinal wires 10 and between each pair of transverse wires forming a depression 24 or depressions 24, 32 to reduce the distance between the pair of transverse wires such that the structure forms a mat of a size to fit within the border wires without more or less than a whole number of spaces.

As a practical matter, the transversely extending wires are attached successively to the longitudinally extending wires and as pairs of transversely extending wires are welded to the longitudinally extending wires, the portions of the longitudinally extending wires between the pairs of transversely extending wires are depressed to form the depressions so that the successive spaces between the transversely extending wires of the mat as it is being formed are shortened by an amount such that the collective spaces provided when a given length of mat is formed correspond to an even number of spaces lengthwise of the border wire for which the mat is being made.

It should be understood that the present disclosure is for the purpose of illustration only and includes all modifications or improvements which fall within the scope of the appended claims.

I claim:

1. The method of making a grid to which coil springs are adapted to be attached for the manufacture of spring assemblies, wherein a plurality of wires are arranged in spaced parallel crossing relation to each other with the wires running in one direction crossing one side of the wires running in the other direction, comprising forming depressions in the portions of the wires running in one direction situated between the portions of the wires running in the other direction downwardly from the plane of the grid by an amount such that the collective depressions reduce the overall length of the wires running in the one direction to a predetermined length corresponding to the desired length of the grid to be made.

2. The method of making a grid of predetermined length in which coil springs are adapted to be attached for the manufacture of spring assemblies, wherein a plurality of wires are arranged in spaced parallel crossing relation to each other with the wires running in one direction crossing the wires running in the other direction and welded at their intersections and wherein the portions of the wires in one direction contain centrally located depressed portions comprising forming the depressions in said portions by depressing the wires by an amount such that the collective displacements reduce the overall length of the wires running in the one direction to said predetermined length.

3. The method of making a grid of predetermined length to which coil springs are adapted to be attached for the manufacture of spring assemblies wherein there are crossing longitudinally and transversely extending spaced parallel wires, welded at their crossings and wherein the longitudinally extending wires are of greater length than said predetermined length, comprising depressing the portions of the longitudinally extended wires between the transversely extending wires sufficiently so that the collective depressions reduce the overall length of the longitudinally extending wires to said predetermined lengths.

4. The method of making a grid of predetermined length to which coil springs are adapted to be attached for the manufacture of spring assemblies wherein there are crossing longitudinally extending spaced parallel wires and transversely extending spaced parallel wires, welded at their crossings and wherein the portions of the longitudinally extending wires between the transversely extending wires contain depressions for attachment of coil springs thereto, comprising initially forming the grid of crossing wires in the longitudinal direction greater in length than said predetermined length and then forming the depressions in said longitudinally extending wires of such depth that they collectively reduce the overall length of the longitudinally extending wires to said predetermined length.

5. A method according to claim 4, comprising forming first depressions in said portions of the longitudinally extending wires for receiving attaching means for the coil springs and second depressions at opposite ends of the first depression such that the collective first and second depressions reduce the overall length of the longitudinally extending wires to said predetermined length.

6. The method of making a grid of predetermined length to which coil springs are adapted to be attached for the manufacture of spring assemblies wherein there are crossing longitudinally extending spaced parallel wires and transversely extending spaced parallel wires, welded at their crossings and wherein the portions of the longitudinally extending wires between the transversely extending wires contain depressions for attaching of coil springs thereto, comprising successively attaching the transversely extending wires to the longitudinally extending wires and displacing the portions of the longitudinally extending wires between pairs of successive transversely extending wires to form such depressions by an amount such that they collectively reduce the distance between successive transversely extending wires sufficiently so that a whole number of the spaces correspond to said predetermined length.

7. The method of making a grid of predetermined length to which coil springs are adapted to be attached for the manufacture of spring assemblies, comprising providing a border wire of predetermined length and width and a mat of longitudinally and transversely spaced parallel wires welded at their crossings and wherein the portions of the longitudinally extending wires between transversely extending wires contain depressions; forming a mat of longitudinally and transversely extending wires welded at their crossings with a predetermined spacing between the transversely extending wires and then forming depressions in the portions of the longitudinally extending wires between the transversely extending wires sufficiently so that a whole number of spaces correspond in length to said predetermined length of the border wire.

* * * * *